US009926738B1

(12) United States Patent
Brown et al.

(10) Patent No.: US 9,926,738 B1
(45) Date of Patent: Mar. 27, 2018

(54) SAFETY GATE

(71) Applicants: Jonathan Brown, Inman, KS (US); Amber Brown, Inman, KS (US)

(72) Inventors: Jonathan Brown, Inman, KS (US); Amber Brown, Inman, KS (US)

( * ) Notice: Subject to any disclaimer, the term of this patent is extended or adjusted under 35 U.S.C. 154(b) by 0 days.

(21) Appl. No.: 15/626,957

(22) Filed: Jun. 19, 2017

(51) Int. Cl.

| | |
|---|---|
| ***E06B 3/68*** | (2006.01) |
| ***E06B 9/04*** | (2006.01) |
| ***E06B 3/46*** | (2006.01) |
| *E06B 9/00* | (2006.01) |

(52) U.S. Cl.
CPC ..... *E06B 9/04* (2013.01); *E06B 3/46* (2013.01); *E06B 2009/002* (2013.01)

(58) Field of Classification Search
CPC ..... E06B 9/04; E06B 3/46; E06B 2009/002
USPC ..... 49/55; 52/656.9
See application file for complete search history.

(56) References Cited

U.S. PATENT DOCUMENTS 192,200 A * 6/1877 Underwood ..... E06B 9/522 160/228
267,519 A * 11/1882 Grimshaw ..... E06B 9/52 160/374
484,418 A * 10/1892 Gabriel ..... E06B 3/481 160/221
597,145 A * 1/1898 Hartzell ..... E06B 7/26 160/50
1,479,239 A * 1/1924 Howell ..... A47G 29/12 220/476
1,756,030 A * 4/1930 Kownatzky ..... E06B 9/522 160/215
2,137,924 A * 11/1938 Schickedanz ..... E06B 7/03 137/625.31
2,175,903 A * 10/1939 Lichtman ..... B01D 46/10 160/374
2,991,843 A * 7/1961 Bell, Jr. ..... E06B 7/03 126/113
3,567,112 A * 3/1971 Wittekind ..... A47G 29/12 232/1 R
4,787,174 A * 11/1988 Brown ..... E06B 9/02 49/55
5,188,646 A * 2/1993 Nolen, Jr. ..... B01D 46/0002 55/486

(Continued)

FOREIGN PATENT DOCUMENTS

CH 710954 A2 * 10/2016 ..... E05G 1/02
FR 2944046 A1 * 10/2010 ..... E06B 9/02

*Primary Examiner* — Jerry E Redman
(74) *Attorney, Agent, or Firm* — Dale J. Ream

(57) ABSTRACT

A safety gate for enclosing a passageway includes first and second gate members situated in an overlapping arrangement for slidable movement horizontally so that a width defined collectively by the gate members is selectable. The second gate member is essentially received by the first gate member. Each gate member includes an upstanding proximal end panel and spaced apart upper and lower panels extending away from the respective proximal end panel, the upper and lower panels having terminal ends, respectively, that together define a void therebetween. Each gate member includes an upper rail member extending horizontally along an upper edge of the first gate member that is perpendicular to respective upper panels. The first and the second rail members are situated one atop the other and share a singular vertical axis extending through them.

10 Claims, 5 Drawing Sheets

(56) References Cited

U.S. PATENT DOCUMENTS

| | | | | | |
|---|---|---|---|---|---|
| 5,272,840 | A * | 12/1993 | Knoedler | E06B 9/04 | 160/228 |
| 5,414,950 | A * | 5/1995 | Johnson, Sr. | A01M 31/025 | 135/119 |
| 5,501,041 | A * | 3/1996 | Fischbeck | E06B 7/03 | 49/55 |
| 5,535,552 | A * | 7/1996 | Stern | E06B 9/02 | 160/225 |
| 5,934,020 | A * | 8/1999 | McCracken | E06B 9/04 | 160/222 |
| 6,284,010 | B1 * | 9/2001 | Rehmert | B01D 46/0002 | 55/385.6 |
| 6,449,901 | B1 | 9/2002 | Gibree et al. | | |
| 9,032,666 | B2 * | 5/2015 | Honeycutt | E06B 11/045 | 49/55 |
| 9,038,313 | B2 | 5/2015 | Morrone, III | | |
| 9,091,113 | B2 | 7/2015 | Pilgrim et al. | | |
| 9,476,239 | B2 | 10/2016 | Honeycutt et al. | | |
| 2006/0042163 | A1 * | 3/2006 | Nitz | E06B 9/04 | 49/55 |
| 2007/0277317 | A1 * | 12/2007 | Ferko | A61G 7/015 | 5/620 |
| 2008/0307708 | A1 * | 12/2008 | Quan | E06B 9/02 | 49/55 |
| 2012/0174484 | A1 * | 7/2012 | Toro | E06B 9/04 | 49/50 |
| 2012/0247056 | A1 * | 10/2012 | Sawyers | E06B 9/52 | 52/656.9 |
| 2013/0086842 | A1 * | 4/2013 | Morrone, III | E06B 9/063 | 49/55 |
| 2014/0326794 | A1 * | 11/2014 | Frank | F24F 11/0012 | 236/49.3 |
| 2017/0086315 | A1 * | 3/2017 | Chen | H05K 5/0004 | |

* cited by examiner

SAFETY GATE

BACKGROUND OF THE INVENTION

This invention relates generally to safety gates and, more particularly, to a safety gate in which a second gate member is received by a first gate member so that the safety gate is thin yet strong and easy to install and adjust.

Gates for preventing children and pets from accessing certain rooms or passageways that could cause injury are well known in the prior art. Variations of such devices have been proposed in the prior patents and in the marketplace. Although presumably effective for their intended purposes, the existing designs are for gate assemblies that are bulky, difficult to operate, or too flimsy to be used effectively in a commercial environment—especially one that is required to meet safety regulations promulgated by the Office of Safety and Health Administration (OSHA).

Therefore, it would be desirable to have a safety gate that is OSHA compliant and has superior strength for preventing a worker from falling into a passageway. Further, it would be desirable to have a safety gate that has a thin profile yet strong and supportive to prevent worker injury.

SUMMARY OF THE INVENTION

A safety gate for enclosing a passageway according to the present invention includes first and second gate members situated in an overlapping arrangement for slidable movement horizontally so that a width defined collectively by the gate members is selectable. The second gate member is essentially received by the first gate member. Each gate member includes an upstanding proximal end panel and spaced apart upper and lower panels extending away from the respective proximal end panel, the upper and lower panels having terminal ends, respectively, that together define a void therebetween. Each gate member includes an upper rail member extending horizontally along an upper edge of the first gate member that is perpendicular to respective upper panels. The first and the second rail members are situated one atop the other and share a singular vertical axis extending through them.

Therefore, a general object of this invention is to provide a safety gate that provides superior strength in preventing a worker from falling down a passageway such as a ladder or stairway leading to a platform or work area.

Another object of this invention is to provide a safety gate, as aforesaid, having first and second gate members situated in an overlapping arrangement for slidable movement horizontally so that a width defined collectively by said first and second gate members is selectable.

Still another object of this invention is to provide a safety gate, as aforesaid, that complies with requirements of the Occupational Safety and Health Administration (OSHA).

Yet another object of this invention is to provide a safety gate, as aforesaid, that includes at least one hand rail atop one or both gate members that is configured to be gripped, leaned on, and is supportive of a worker when operating the safety gate or walking proximate the passageway.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
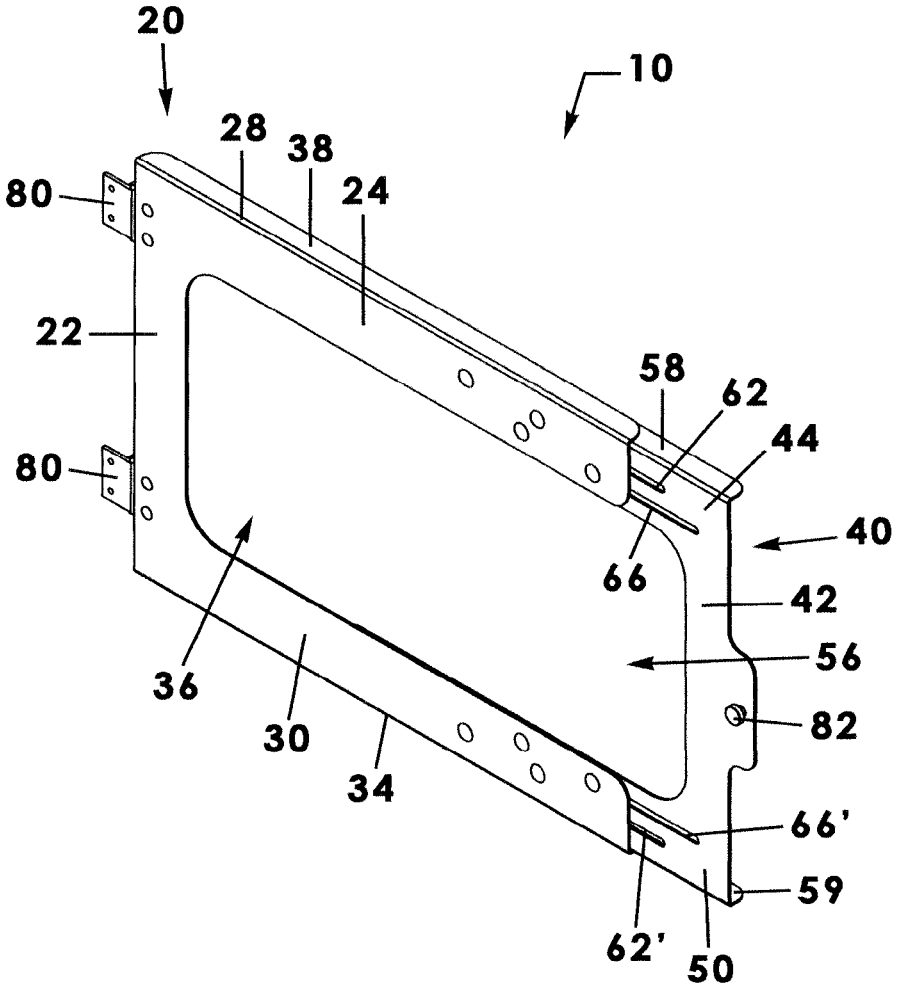
FIG. 1 is a perspective view of a safety gate according to the present invention, illustrating a large embodiment of the safety gate in which first and second gate members are in a shortened width configuration.

A safety gate according to a preferred embodiment of the present invention will now be described in detail with reference to FIGS. 1 to 5 of the accompanying drawings. The safety gate 10 includes a first gate member 20 and a second gate member 40 situated in an overlapping arrangement for slidable movement horizontally relative to one another so that a width defined collectively by the gate members is selectable and adjustable. The second gate member 40 is received by the first gate member 20 in a nested relationship such that respective upper rail members 38, 58 share a common vertical axis.

The safety gate 10 has a construction and configuration that is very thin yet very strong so as to guard against and prevent a worker from accidentally falling down a passageway, such as a ladder or stairway to a platform. Preferably, each of a first gate member 20 and second gate member 40 includes a singular construction, such as a flat or planar sheet of steel although other materials having strong and durable qualities would also work. Although being of a singular construction, each panel is more understandably described by reference to its component parts.

The first gate member 20 includes a proximal end panel 22 situated in an upright or upstanding orientation. The proximal end panel 22 establishes a closed proximal end of the first gate member 20. The first gate member 20 includes an upper panel 24 and a lower panel 30 extending away from the proximal end panel 22 and parallel to one another. The upper and lower panels include terminal ends 26, 32 opposite and displaced from the proximal end panel 22, respectively. The terminal ends 26, 32 define a void therebetween.

More broadly, the proximal end panel 22, upper panel 24, and lower panel 30 of the first gate member 20, in combination, define a first open interior area 36. To be clear, the proximal end panel 22, upper panel 24, and lower panel 30 have a front surface and opposed back surface that is flat and defines a vertical plane, the upper panel 24 having an upper edge 28 and the lower panel defining a lower edge 34.

In like manner, the second gate member 40 includes a proximal end panel 42 situated in an upright or upstanding orientation. The proximal end panel 42 establishes a closed proximal end of the second gate member 40. The second gate member 40 includes an upper panel 44 and a lower panel 50 extending away from the proximal end panel 42 and parallel to one another. The upper and lower panels include terminal ends 46, 52 opposite and displaced from the proximal end panel 42, respectively. The terminal ends 46, 52 define a void therebetween.

More broadly, the proximal end panel 42, upper panel 44, and lower panel 50 of the second gate member 40, in combination, define a second open interior area 56. To be clear, the proximal end panel 442, upper panel 44, and lower panel 50 of the second gate member 40 have a front surface and opposed back surface that is flat and defines a vertical plane, the upper panel 44 defining an upper edge 48 and the lower panel 50 defining a lower edge 54.

Figure 2A:
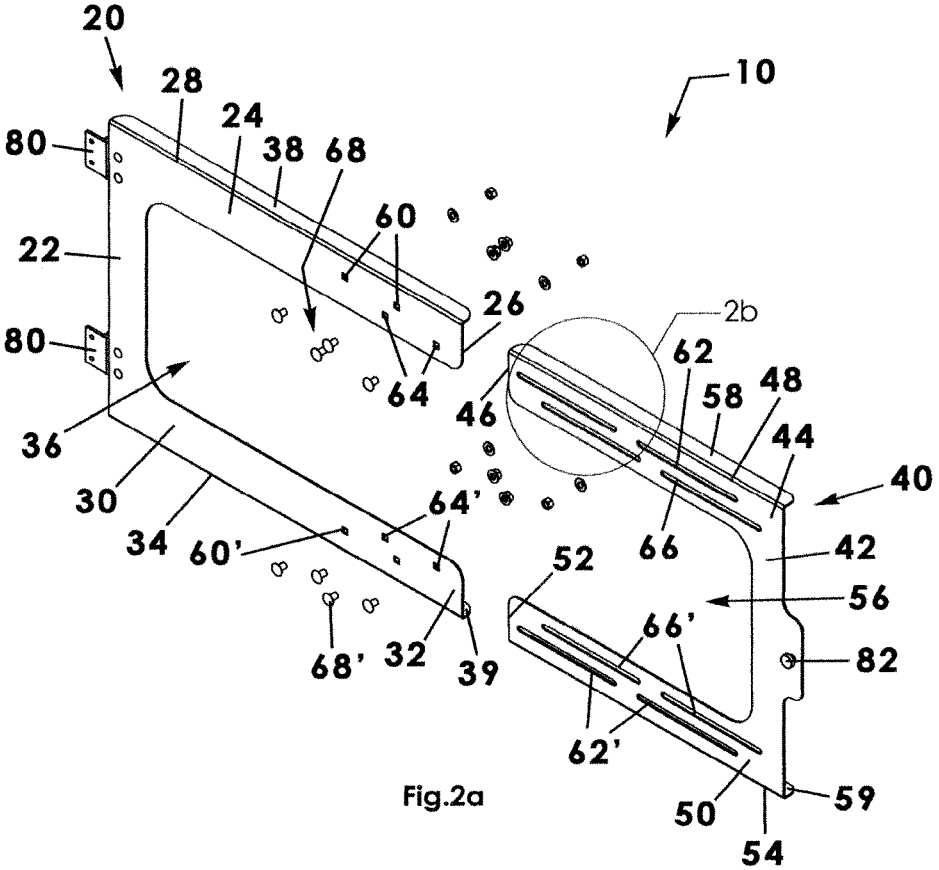
FIG. 2*a* is an exploded view of the safety gate as in FIG. 1.

As shown and described, each first gate member 20 and second gate member 40 has a generally U-shaped configuration. Each gate member is oriented on its side (i.e. "sideways") with terminal ends, 28, 32, 46, 52 facing one another when assembled for movement together as a safety gate 10 (FIG. 2). Together, the first interior area 36 and second interior area 56 combine to define an overall interior area.

The first gate member 20 includes an upper rail member 38 extending in a horizontal plane along the upper edge 28 of the upper panel 24 of the first gate member 20. To be clear, the upper rail member 38 of the upper panel 24 of the first gate member 20 is in a horizontal plane perpendicular to the vertical plane defined by the front and back surfaces of the upper panel 24 of the first gate member 20.

Preferably having a singular construction, the upper rail member 38 and upper panel 24 of the first gate member 20 may be a 90 degree reinforcing bend of the material at the upper edge 28 of the upper panel 24 into an L-shaped configuration. The upper rail member 38 of the first gate member 20 is configured to be gripped, leaned on, and is supportive of a worker—giving stability and safety to a worker in the vicinity of the passageway.

In like manner, the second gate member 40 includes an upper rail member 58 extending in a horizontal plane along the upper edge 48 of the upper panel 44 of the second gate member 40. To be clear, the upper rail member 58 of the upper panel 44 of the second gate member 40 is in a horizontal plane perpendicular to the vertical plane defined by the front and back surfaces of the upper panel 44 of the second gate member 40.

Preferably having a singular construction, the upper rail member 58 and upper panel 44 of the second gate member 40 may be a 90 degree reinforcing bend of the material at the upper edge 48 of the upper panel 44 into an L-shaped configuration. The upper rail member 58 of the second gate member 40 is configured to be gripped, leaned on, and is supportive of a worker—giving stability and safety to a worker in the vicinity of the passageway.

Similarly, each gate member 20, 40 includes a lower rail member 39, 59 essentially identical to the upper rail members 38, 48 described above. More particularly, the first gate member 20 includes a lower rail member 39 extending in a horizontal plane along the lower edge 34 of the lower panel 30 of the first gate member 20. To be clear, the lower rail member 39 is in a horizontal plane perpendicular to the vertical plane defined by the front and back surfaces of the lower panel 30 of the first gate member 20. Preferably having a singular construction, the lower rail member 39 and lower panel 30 of the first gate member 20 may be 90 degree reinforcing bend of the material at the lower edge 34 of the lower panel 30 into an L-shaped configuration.

In like manner, the second gate member 40 includes a lower rail member 59 extending in a horizontal plane along the lower edge 54 of the lower panel 50 of the second gate member 40. The lower rail member 59 is in a horizontal plane perpendicular to the vertical plane defined by the front and back surfaces of the lower panel 50 of the second gate member 40. Preferably having a singular construction, the lower rail member 59 and lower panel 50 of the second gate member 40 may be 90 degree reinforcing bend of the material at the lower edge 54 of the lower panel 50 into an L-shaped configuration.

The second gate member 40 has a dimension slightly smaller than that of the first gate member 20 such that the first gate member 20 is configured to receive the second gate member 40 in a nested relationship. Specifically, the proximal end panel 42 of the second gate member 40 includes a length slightly shorter than a length of the proximal end panel 22 of the first gate member 20. Consequently, the upper rail member 38 and upper panel 24 of the first gate member 20 receives the upper rail member 58 and upper panel 44 of the second gate member 40 in a nested and gentle friction fit engagement. Simultaneously, the lower rail member 39 and lower panel 30 of the second gate member 40 receives the lower rail member 59 and lower panel 50 of the second gate member 40 in a nested and gentle friction fit engagement. Terminal ends 46, 52 of the upper and lower panels of the second gate member 40 are inserted first adjacent corresponding terminal ends 26, 32 of upper and lower panels of the first gate member 20 in the direction toward the proximal end panel 22 of the first gate member 20 in order to decrease the width of the safety gate 10. When nested, a singular imaginary vertical axis extends through corresponding upper rail members 38, 58 and corresponding lower rail members 39, 59, the associated rail members being situated one atop the other, respectively.

In another aspect, the first gate member 20 and second gate member 40 may be selectively coupled together at a desired width. More particularly, the upper panel 24 of the first gate member 20 defines a primary aperture 60 or bore therethrough proximate to a respective terminal end 26. In an embodiment, more than one primary aperture 60 may be included. Correspondingly, the upper panel 42 of the second gate member 40 includes a primary slot 62 extending longitudinally therealong. Then, when the first gate member 20 receives the second gate member 40 in an overlapping slidable arrangement, the primary aperture 60 is aligned with the primary slot 62 such that the gate members may be secured at a desired width with a fastener 68, such as a bolt/screw combination.

In an embodiment, the upper panel 24 of the first gate member 20 may define an auxiliary aperture 64 (or even a plurality auxiliary apertures) spaced apart from the primary aperture 60. Correspondingly, the upper panel 44 of the second gate member 40 may define an auxiliary slot 66 (or plurality of auxiliary slots) extending longitudinally therealong. Then, the first gate member 20 may again be coupled to the second gate member 40 when an auxiliary fastener is passed through aligned apertures and slots. It is understood that the auxiliary apertures, slots, and fasteners provide a failsafe and enhanced securement of the gate members at a selected width.

The lower panel 30 of the first gate member 20 and the lower panel 50 of the second gate member 40 also include one or more apertures, slots, and fasteners as described above with respect to the upper panels, respectively. These structures are represented in the drawings with primed reference numerals corresponding to the structures described above.

In still another aspect, the safety gate 10 may be coupled to structures on either side of a passageway. First, one or a pair of hinge fasteners 80 may be coupled to the upstanding proximal end panel 22 of the first gate member 20. The hinge fasteners 80 may then be coupled to a structure adjacent a passageway, such as to the bars of a ladder or staircase to a platform or other work site. Similarly, a mounting flange 82 may be coupled to the upstanding proximal end panel 42 of the second gate member 40. The mounting flange 82 may then be coupled to a structure opposite that to which the hinge fasteners 80 are coupled once the desired width has been set as described above. It is understood that when the mounting flange 82 is released or uncoupled from the passageway structure, the safety gate 10 may be pivoted open or closed by operation of the hinge fasteners 80. The hinge fasteners 80 may be referred to as first mounting fasteners and the mounting flange 82 may also be referred to as second mounting fasteners.

Figure 2B:
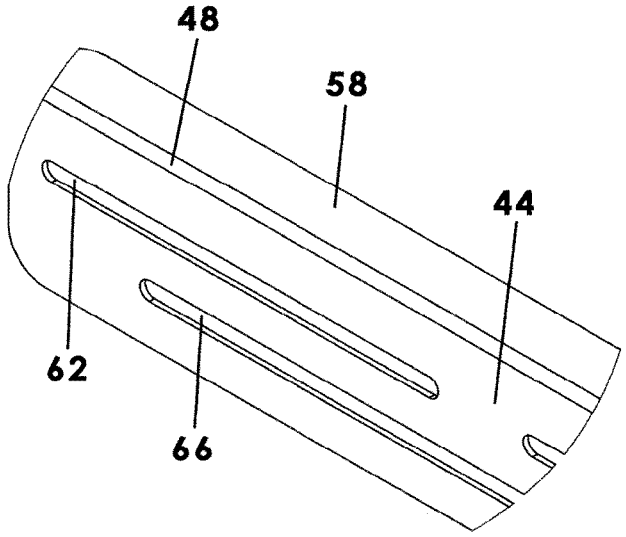
FIG. 2*b* is an isolated view on an enlarged scale taken from FIG. 2*a;*
Figure 3A:
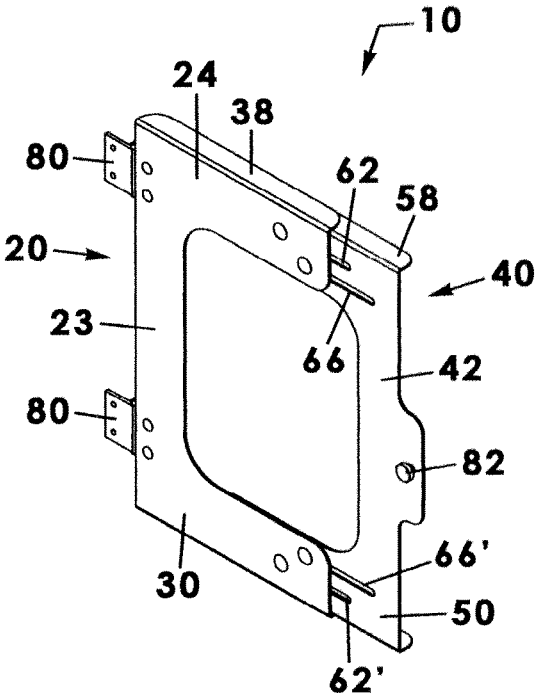
FIG. 3*a* is a perspective view of a safety gate according to the present invention, illustrating a small embodiment of the safety gate in which first and second gate members are in a shortened width configuration.
Figure 3B:
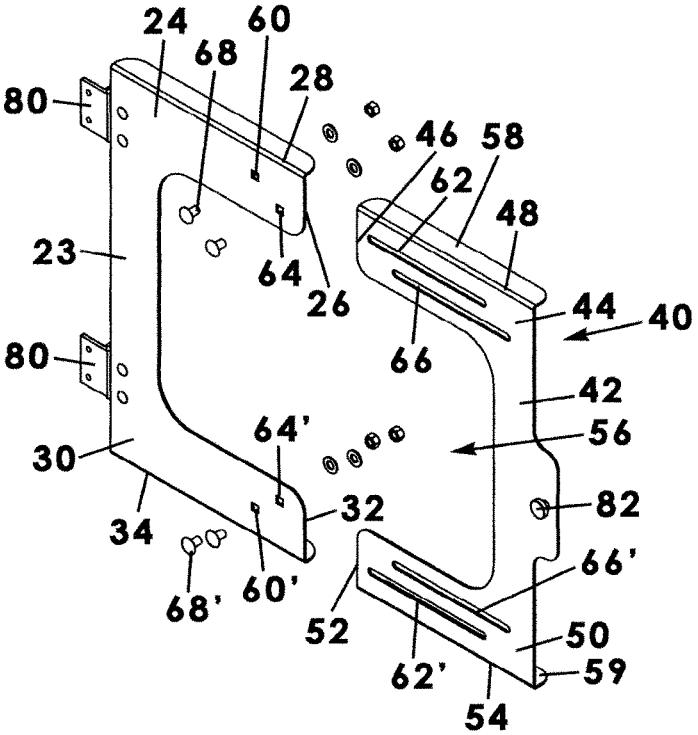
FIG. 3*b* is an exploded view of the safety gate as in FIG. 3.
Figure 4:
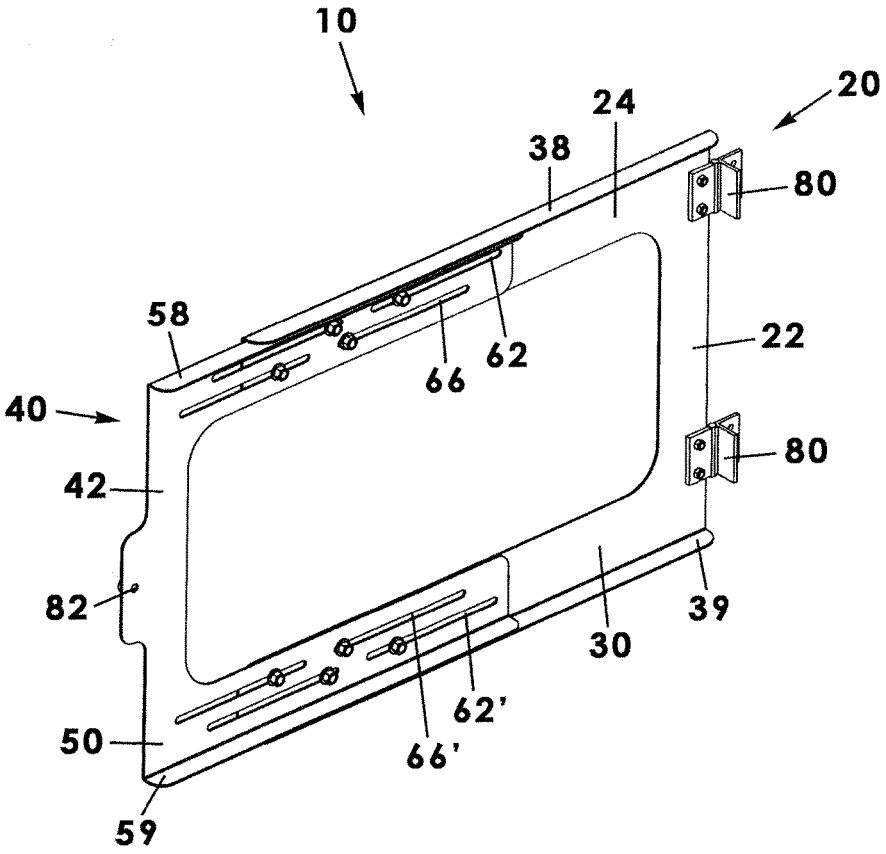
FIG. 4 is a rear perspective view of the safety gate as in FIG. 1.
Figure 5:
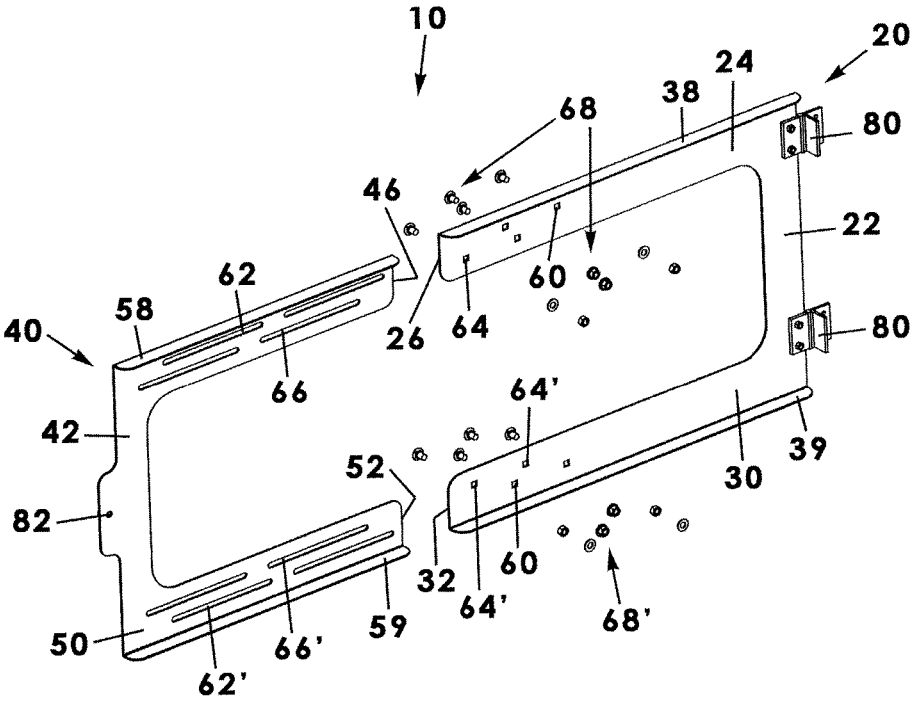
FIG. 5 is an exploded view of the safety gate as in FIG. 5.

As shown in the accompanying drawings, the safety gate 10 may be produced in various sizes depending on the width of a passageway intended to be covered. For instance, a safety gate 10 that is large and can accommodate a large width is shown in FIGS. 1 to 2*b* whereas a safety gate 10 having smaller gate members suitable for covering a passageway having a smaller width is shown in FIGS. 3*a* and 3*b*.

In use, the safety gate 10 may be mounted to sides of a passageway, such as a ladder or stairs to a platform or work area. The gate members may then be sized laterally to cover the width of the passageway and the gate members may be secured with fasteners extending through respective apertures and slots as described above. Secondary or auxiliary fasteners may also be engaged as a failsafe procedure to enhance safety.

It is understood that while certain forms of this invention have been illustrated and described, it is not limited thereto except insofar as such limitations are included in the following claims and allowable functional equivalents thereof.

The invention claimed is:

1. A safety gate for enclosing a passageway, comprising:

a first gate member having an upstanding proximal end panel and spaced apart upper and lower panels extending away from said proximal end panel, said upper and lower panels having terminal ends, respectively, that together define a void therebetween;

a second gate member having an upstanding proximal end panel and spaced apart upper and lower panels extending away from said proximal end panel, said upper and lower panels having terminal ends, respectively, that together define a void therebetween;

wherein said upper and lower panels of said first and second gate members have a planar configuration;

wherein said upper panel of said first gate member defines a primary aperture proximate said terminal end thereof;

wherein said upper panel of said second gate member defines a primary slot extending longitudinally therealong;

wherein said first and second gate members are situated in an overlapping and slidable arrangement in which said first gate member selectively receives said second gate member such that said primary aperture is aligned with said primary slot;

a fastener selectively extending through said primary aperture and said primary slot for coupling said second gate member to said first gate member at a selected width;

said upper panel of said first gate member defines an auxiliary aperture proximate said terminal end thereof;

said upper panel of said second gate member defines an auxiliary slot extending longitudinally therealong;

said first and second gate members are situated in an overlapping and slidable arrangement such that said auxiliary aperture is aligned with said auxiliary slot;

said safety gate further comprising an auxiliary fastener that selectively extends through said auxiliary aperture and said auxiliary slot for coupling said second gate member to said first gate member at a selected width;

wherein said auxiliary slot is displaced from and generally parallel to said primary slot.

2. The safety gate as in claim 1, further comprising a pair of first mounting fasteners coupled to said upstanding proximal end panel of said first gate member for attaching said upstanding proximal end panel of said first gate member to a structure adjacent the passageway.

3. The safety gate as in claim 2, further comprising a second mounting fastener coupled to said upstanding proximal end panel of said second gate member for attaching said upstanding proximal end panel of said second gate member to a structure adjacent the passageway, said second mounting fastener being opposite and displaced from said pair of first mounting fasteners.

4. The safety gate as in claim 1, wherein said second gate member is slidably received by said first gate member with respective terminal ends of said second gate member being received first and in a direction approaching said upstanding proximal end panel.

5. The safety gate as in claim 4, wherein a width defined by said first and second gate members is decreased as said respective terminal ends of said second gate member are slidably moved in the direction approaching said upstanding proximal end panel of said first gate member.

6. The safety gate as in claim 1, wherein:

said first gate member includes an upper rail member situated along an upper edge of said upper panel of said first gate member and is generally perpendicular therewith;

said second gate member includes a second rail member situated along an upper edge of said upper panel of said second gate member and is generally perpendicular therewith;

said second gate member having a dimension smaller than a dimension of said first gate member so that said upper panel and said upper rail of said second gate member are received by said upper panel and said upper rail member of said first gate member in a nested relationship.

7. The safety gate as in claim 6, wherein said upper rail member of said first gate member and said upper rail member of said second gate member are situated one atop the other and share a singular imaginary vertical axis when said second gate member is received by said first gate member.

8. A safety gate for enclosing a passageway, comprising:

a first gate member having an upstanding proximal end panel and spaced apart upper and lower panels extending away from said proximal end panel, said upper and lower panels having terminal ends, respectively, that together define a void therebetween;

a second gate member having an upstanding proximal end panel and spaced apart upper and lower panels extending away from said proximal end panel, said upper and lower panels having terminal ends, respectively, that together define a void therebetween;

wherein said upper and lower panels of said first and second gate members have a planar configuration;

wherein said upper panel of said first gate member defines a primary aperture proximate said terminal end thereof;

wherein said upper panel of said second gate member defines a primary slot extending longitudinally therealong;

wherein said first and second gate members are situated in an overlapping and slidable arrangement in which said first gate member selectively receives said first gate member such that said primary aperture is aligned with said primary slot;

a fastener selectively extending through said primary aperture and said primary slot for coupling said second gate member to said first gate member at a selected width;

wherein each of said first and second gate members has a generally U-shaped configuration oriented sideways such that said upstanding proximal end walls are closed and respective terminal ends of respective upper and lower panels are open;

said upper panel and said upper rail member of said first gate member have a singular construction with a reinforcing bend into an L-shaped configuration;

said upper panel and said upper rail member of said second gate member have a singular construction with a reinforcing bend into an L-shaped configuration.

9. The safety gate as in claim 8, wherein said first and second gate members define an open interior area between said upper and lower panels, respectively.

10. The safety gate as in claim 8, wherein:

said upper panel of said first gate member defines an auxiliary aperture proximate said terminal end thereof;

said upper panel of said second gate member defines an auxiliary slot extending longitudinally therealong;

said first and second gate members are situated in an overlapping and slidable arrangement such that said auxiliary aperture is aligned with said auxiliary slot;

said safety gate further comprising an auxiliary fastener that selectively extends through said auxiliary aperture and said auxiliary slot for coupling said second gate member to said first gate member at a selected width;

said auxiliary slot is displaced from and generally parallel to said primary slot.

* * * * *